US009228396B2

(12) United States Patent
Yamahata et al.

(10) Patent No.: US 9,228,396 B2
(45) **Date of Patent: *Jan. 5, 2016**

(54) RECOVERY VALVE

(71) Applicant: ONESUBSEA IP UK LIMITED, London (BR)

(72) Inventors: Sergio Yamahata, Rio de Janeiro (BR); Carlos Aparecido de Oliveira, Rio de Janeiro (BR)

(73) Assignee: OneSubsea IP UK Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/557,198

(22) Filed: Dec. 1, 2014

(65) Prior Publication Data

US 2015/0083431 A1 Mar. 26, 2015

Related U.S. Application Data

(63) Continuation of application No. 13/196,383, filed on Aug. 2, 2011, now Pat. No. 8,925,635.

(51) Int. Cl.

| | |
|---|---|
| ***E21B 33/064*** | (2006.01) |
| ***E21B 34/04*** | (2006.01) |
| ***E21B 33/06*** | (2006.01) |
| ***E21B 19/00*** | (2006.01) |
| ***E21B 33/043*** | (2006.01) |
| ***E21B 21/00*** | (2006.01) |
| ***E21B 31/03*** | (2006.01) |

(52) U.S. Cl.

CPC ..... *E21B 19/002* (2013.01); *E21B 21/001* (2013.01); *E21B 31/03* (2013.01); *E21B 33/043* (2013.01); *E21B 33/063* (2013.01); *E21B 33/064* (2013.01); *E21B 34/04* (2013.01); *E21B 34/045* (2013.01)

(58) Field of Classification Search

CPC ..... E21B 33/063; E21B 33/064; E21B 34/04; E21B 34/045

USPC ..... 166/338, 340, 348, 363, 364, 365, 373, 166/386, 75.14, 368; 251/324, 325

See application file for complete search history.

(56) References Cited

U.S. PATENT DOCUMENTS 3,482,600 A * 12/1969 Hodgson ..... 137/596.2
4,067,062 A 1/1978 Baugh (Continued)

OTHER PUBLICATIONS

PCT International Search Report and Written Opinion for PCT/US2012/048840, dated Feb. 22, 2013.

*Primary Examiner* — Matthew Buck
(74) *Attorney, Agent, or Firm* — Chamberlain Hrdlicka

(57) ABSTRACT

A tubing hanger landing system includes a tubing hanger running tool, a locking flowline to lock the tubing hanger running tool into a tubing hanger, and a lower body shear joint comprising a recovery valve. The recovery valve includes a valve body with a functional port, an operational port, a bi-directional port, and a relief port, and a valve piston positioned within the valve body and movable between an operational position and a relief position within the valve body. The functional port enables pressure to be communicated to the valve piston to move the valve piston from the operational position to the relief position, and, in the relief position, the valve piston provides fluid communication through a relief flowpath between the bi-directional port and the relief port to release pressure from the locking flowline.

20 Claims, 5 Drawing Sheets

(56) References Cited

U.S. PATENT DOCUMENTS

| | | | | | |
|---|---|---|---|---|---|
| 4,098,335 | A | | 7/1978 | Goad | |
| 4,736,799 | A | * | 4/1988 | Ahlstone | 166/348 |
| 4,880,061 | A | * | 11/1989 | Ahlstone | 166/348 |
| 4,969,519 | A | * | 11/1990 | Kelly | 166/348 |
| 6,082,460 | A | * | 7/2000 | June | 166/348 |
| 6,186,237 | B1 | * | 2/2001 | Voss et al. | 166/337 |
| 6,253,854 | B1 | * | 7/2001 | Fenton | 166/364 |
| 6,343,654 | B1 | * | 2/2002 | Brammer | 166/338 |
| 8,925,635 | B2 | * | 1/2015 | Yamahata et al. | 166/338 |

* cited by examiner

RECOVERY VALVE

BACKGROUND

In subsea hydrocarbon drilling operations, a blowout preventer ("BOP") is used to form a pressure-tight seal at the top of a well and prevent the escape of formation fluids. A ram BOP achieves pressure control through the operation of ram blocks. The ram blocks are grouped in opposing pairs and are forced together during operation. Certain types of ram BOPs employ ram blocks designed to shear through pipe in the wellbore (e.g., drillpipe, a liner, or a casing string), hang the pipe off on the ram blocks, and seal the wellbore.

In some instances, a shear joint and tubing hanger running tool ("THRT") are coupled to a tubing hanger below the BOP rams. Thus, when the ram blocks are brought together to shear a pipe in the wellbore, communication (e.g., hydraulic) is cut between the surface rig and the lower body shear joint, THRT, and tubing hanger. However, well operators may desire to recover the shear joint and THRT to the surface to successfully complete installation of a Christmas tree on the wellhead.

The shear joint and THRT may be recovered by installing a shear joint recovery tool over the cut pipe and making up to the shear joint. Through hydraulic lines tied back to the surface, pressure is applied to unlock the THRT from the tubing hanger, enabling the THRT to be retrieved to the surface. However, in certain situations the shear joint recovery tool cannot be installed over the cut pipe because the pipe may be too deformed, which does not allow proper installation of the shear joint recovery tool. The shear joint and THRT may also be recovered by using a hotstab to apply pressure directly into the shear joint, unlocking the THRT from the tubing hanger. However, using a hotstab to apply pressure requires the removal of the drilling riser and the BOP, which can be difficult and time consuming.

SUMMARY OF DISCLOSED EMBODIMENTS

In one embodiment, a tubing hanger landing system includes a tubing hanger running tool, a locking flowline to lock the tubing hanger running tool into a tubing hanger, and a lower body shear joint having a recovery valve. The recovery valve includes a valve body having an operational port, a bi-directional port, and a relief port and an internal piston cavity. The piston cavity includes a radially inwardly extending stop, a valve piston housed in the valve body piston cavity and partially extending through the radially inwardly extending stop and movable between an operational position and a relief position by moving relative to the radially inwardly extending stop. The valve piston includes a radially extending collar. The valve body further includes a shear port that allows pressure communication between the exterior of the recovery valve and the valve piston, a shear ring attached and surrounding the piston collar and sized larger than the radially inwardly extending stop such that the valve piston is prevented from moving from the operational position to the relief position. The shear ring is shearable from the valve piston when subjected to a pressure of the exterior of the recovery valve through the shear port that exceeds a shear force of the shear ring, allowing the valve piston to be movable to the relief position. In the relief position, the valve piston provides fluid communication through a relief flowpath between the bi-directional port and the relief port to release pressure from the locking flowline.

In another embodiment, recovery valve includes a valve body having an operational port, a bi-directional port, and a relief port and an internal piston cavity. The piston cavity includes a radially inwardly extending stop, a valve piston housed in the valve body piston cavity and partially extending through the radially inwardly extending stop and movable between an operational position and a relief position by moving relative to the radially inwardly extending stop. The valve piston includes a radially extending collar. The valve body further includes a shear port that allows pressure communication between the exterior of the recovery valve and the valve piston, a shear ring attached and surrounding the piston collar and sized larger than the radially inwardly extending stop such that the valve piston is prevented from moving from the operational position to the relief position. The shear ring is shearable from the valve piston when subjected to a pressure of the exterior of the recovery valve through the shear port that exceeds a shear force of the shear ring, allowing the valve piston to be movable to the relief position. In the relief position, the valve piston provides fluid communication through a relief flowpath between the bi-directional port and the relief port to release pressure from a locking flowline.

In yet another embodiment, a method of recovering a tubing hanger running tool (THRT) from a subsea well includes locking the THRT into a tubing hanger by applying hydraulic pressure to a locking flowline of the THRT through a recovery valve having a valve piston in an operational position. The method further includes shearing a drill pipe with a shear ram, injecting kill fluid having a pressure into an annulus between the shear ram and the tubing hanger, releasing the hydraulic pressure applied to the THRT to lock the THRT into the tubing hanger into an area having a lower pressure than the hydraulic pressure applied when the valve piston is in a relief position, and unlocking the THRT from the tubing hanger. The kill fluid pressure causes the valve piston to be in the relief position.

BRIEF DESCRIPTION OF DRAWINGS

For a more detailed description of the embodiments, reference will now be made to the following accompanying drawings.

DETAILED DESCRIPTION OF THE DISCLOSED EMBODIMENTS

Figure 1:
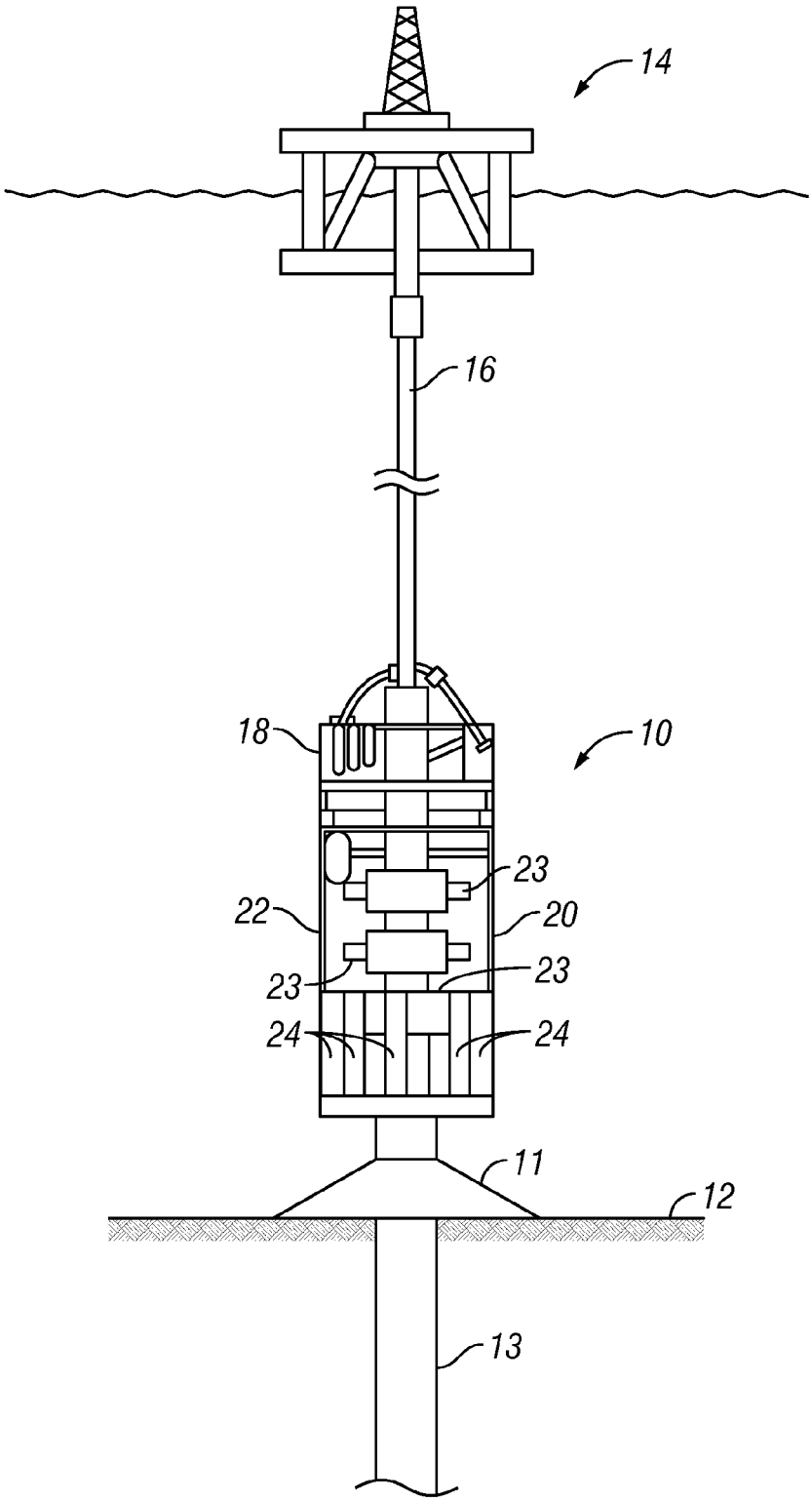
FIG. 1 shows a schematic view of an embodiment of a subsea hydrocarbon well in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms connect, engage, couple, attach, or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a subsea BOP stack assembly 10 is assembled onto a wellhead assembly 11 on the sea floor 12. The BOP stack assembly 10 is connected in line between the wellhead assembly 11 and a floating rig 14 through a subsea riser 16. The BOP stack assembly 10 provides emergency pressure control of drilling/formation fluid in the wellbore 13 should a sudden pressure surge escape the formation into the wellbore 13. The BOP stack assembly thus prevents damage to the floating rig 14 and the subsea riser 16 from fluid pressure exiting the seabed wellhead.

The BOP stack assembly 10 includes a BOP lower marine riser package 18 that connects the riser 16 to a BOP stack package 20. The BOP stack package 20 includes a frame 22, BOPs 23, and accumulators 24 that may be used to provide back up hydraulic fluid pressure for actuating the BOPs 23. In some embodiments, the BOPs 23 are ram-type BOPs.

Figure 2:
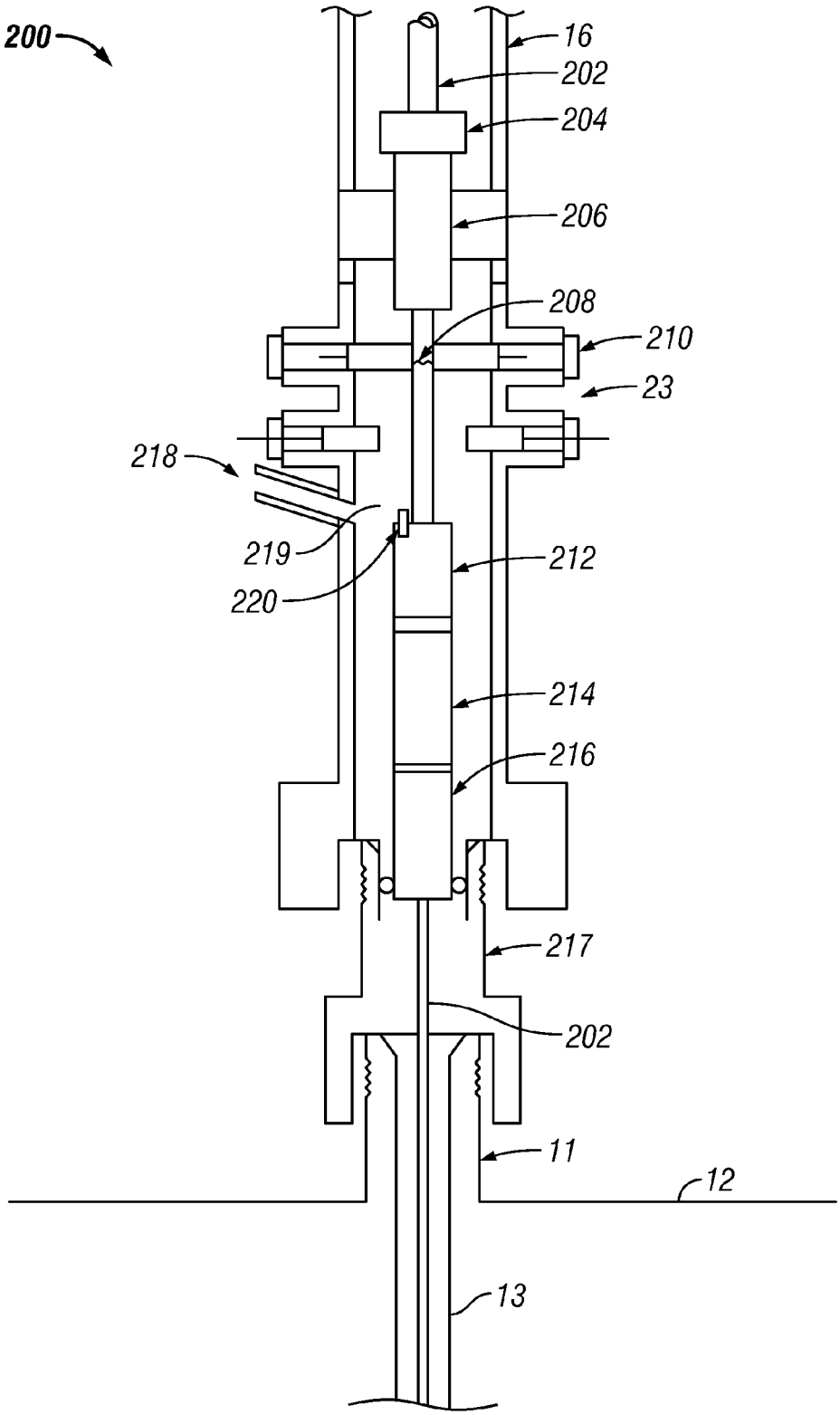
FIG. 2 shows a vertical view of a blowout preventer with housing removed in accordance with various embodiments.

FIG. 2 shows a subsea assembly 200 in accordance with various embodiments. The riser 16 contains shear tubing 202, which couples to an upper body shear joint 204 and a pack off shear joint 206. Below the pack off shear joint 206, the shear tubing 202 comprises a shear point 208, which is where the shear ram 210 of BOP 23 severs the shear tubing 202 when the shear ram 210 is activated. Below the shear point 208, the shear tubing 202 couples to a lower body shear joint 212 and a THRT 214, which is used to install a tubing hanger 216 on a hanger adapter base 217 situated on the wellhead 11. A kill line 218 is used to pump kill fluid directly into the annulus 219 below the shear ram 210. In accordance with various embodiments, one portion of a recovery valve 220 is exposed to the kill fluid pumped through the kill line 218 following activation of the shear ram 210.

Figure 3:
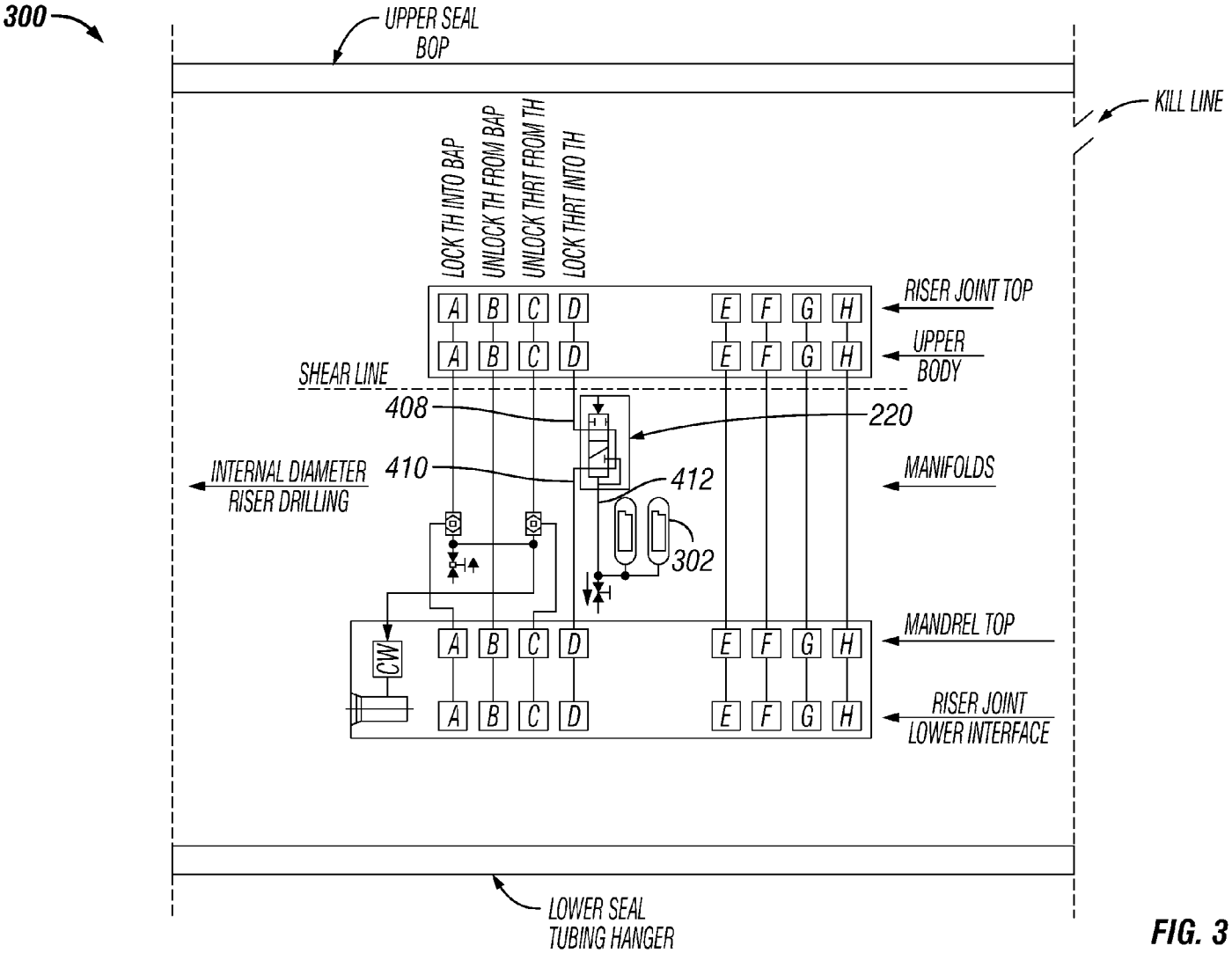
FIG. 3 shows a hydraulic diagram in accordance with various embodiments.

FIG. 3 shows the recovery valve 220 in a hydraulic diagram 300 in accordance with various embodiments. Referring to hydraulic lines A-D, applying pressure via these lines invokes certain actions relating to the locking and unlocking of components, such as the tubing hanger 216, the tubing hanger adapter base 217, and the THRT 214. For example, applying pressure to flowline A locks the tubing hanger 216 into the tubing hanger adapter base 217. Applying pressure to flowline B while releasing pressure from flowline A unlocks the tubing hanger 216 from the tubing hanger adapter base 217. Similarly, applying pressure to flowline D locks the THRT 214 into the tubing hanger 216 and applying pressure to flowline C while releasing pressure from flowline D unlocks the THRT 214 from the tubing hanger 216. In some instances, flowline D may be referred to as a "locking flowline" and flowline C may be referred to as an "unlocking flowline."

Referring to FIGS. 2 and 3, when the shear ram 210 is activated, the flowlines are cut. The area between the seal created by the BOP 23 and the lower seal created between the tubing hanger 216 and the tubing hanger adapter base 217 is subjected to kill pressure when kill fluid is pumped through the kill line 218. Thus, the kill pressure is applied to the sheared flowlines and, in particular, flowlines C and D, preventing unlocking of the THRT 214 from the tubing hanger 216, because pressure is being applied to flowline D. In accordance with various embodiments, the recovery valve 220 enables a release of hydraulic pressure from flowline D into an empty reservoir 302 when the recovery valve 220 is subjected to the kill pressure. As a result, pressure is released from flowline D and the kill pressure is applied to flowline C, which is exposed to the kill fluid, causing the THRT 214 to unlock from the tubing hanger 216. In accordance with various embodiments, unlocking the THRT 214 from the tubing hanger 216 is achieved without the use of a hot stab type operation.

Figure 4A:
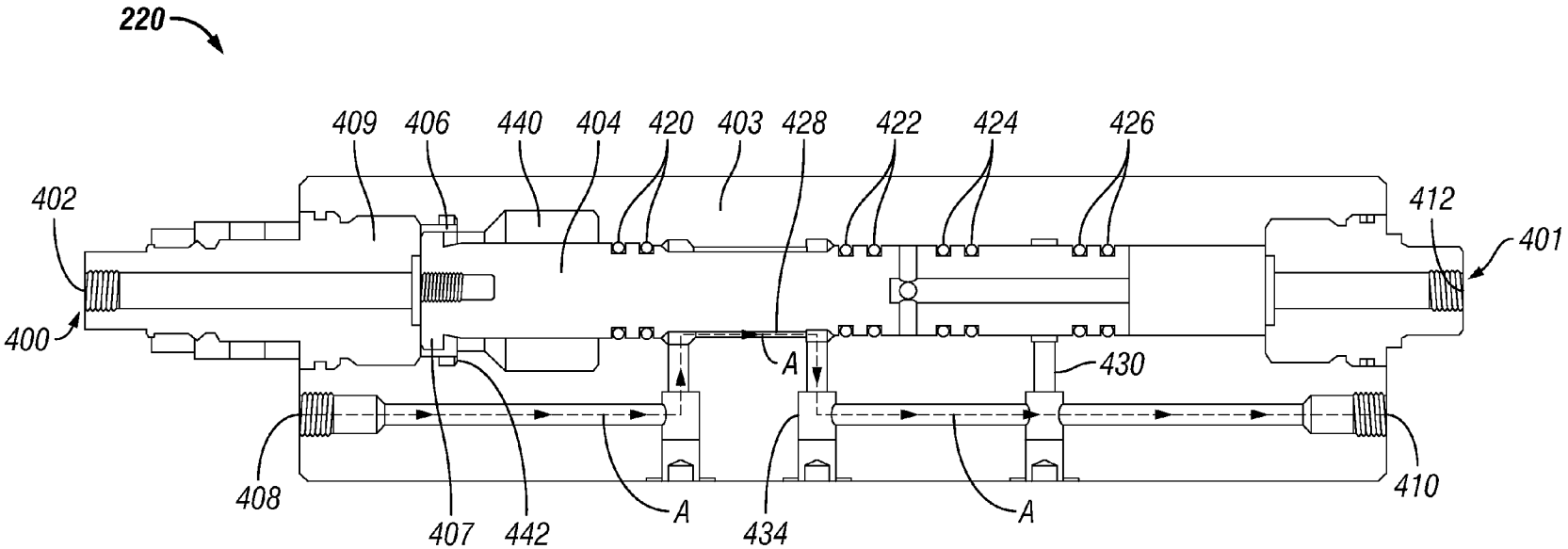
FIG. 4*a* shows a recovery valve in accordance with various embodiments.
Figure 4B:
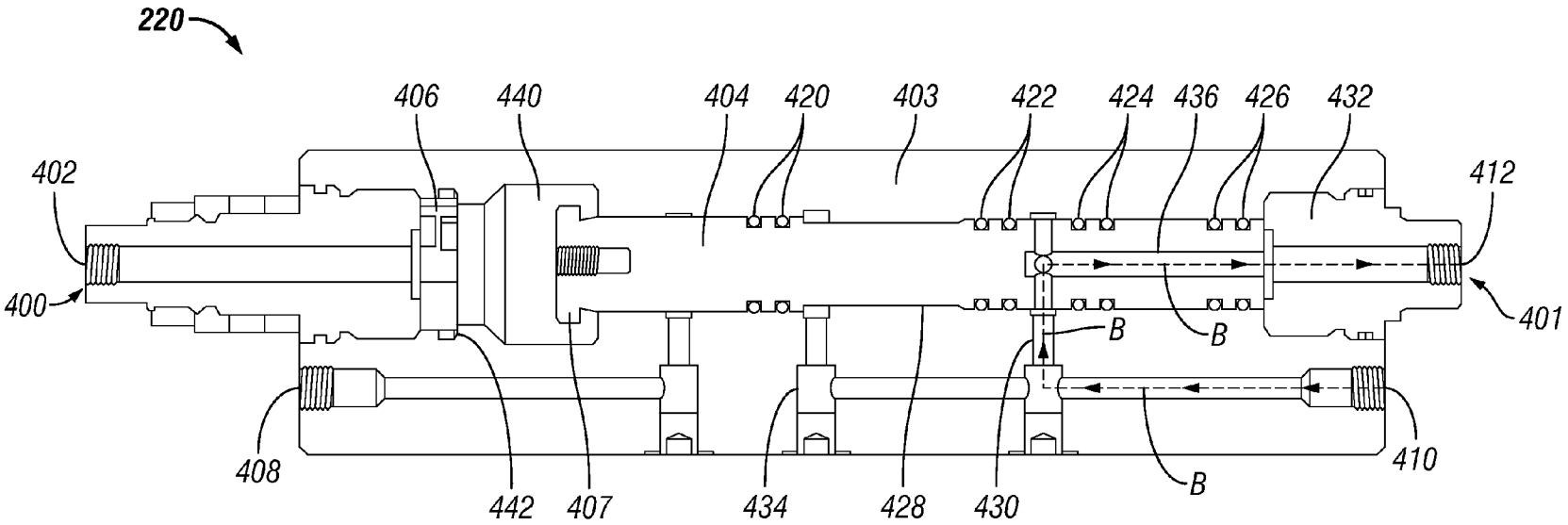
FIG. 4*b* shows a recovery valve in accordance with various embodiments.

Referring now to FIGS. 4*a* and 4*b*, the recovery valve 220 is described in further detail. FIG. 4*a* shows the recovery valve 220 in an operational position. A first end 400 of the recovery valve 220 comprises a shear port 402 and a shear port body 409. The shear port 402 is in fluid contact with the annulus 219 and thus is exposed to kill pressure when the BOP 23 is activated. The shear port body 409 is coupled to a valve body 403. The recovery valve 220 also comprises a valve piston or flow passage diversion member 404, which is housed in the valve body 403. The valve body includes a piston cavity 440 having a radially inwardly extending stop 442. The valve piston 404 comprises a collar 407 that extends radially outward and is sealed against the shear port 402 due to a shear ring 406 that occludes the collar 407 and holds the valve piston 404 against the shear port body 409. The shear ring 406 is selected based on the water depth at which the recovery valve 220 is installed because the kill pressure varies with water depth. The shear ring 406 is larger than the radially inwardly extending stop 442 and thus is prevented from moving into the piston cavity 440. The shear ring 406 has a shear pressure that is less than the kill pressure, so that the shear ring 406 will shear when subjected to the kill pressure.

In the operational position, the valve piston 404 of the recovery valve 220 provides fluid communication between an operational port 408 and a bi-directional port 410. In accordance with various embodiments, the fluid path A couples the operational port 408 to the bi-directional port 410, enabling hydraulic pressure to be applied to flowline D. The valve piston 404 comprises seals 420 and 422 that prevent fluid from flowing outside of a portion 428 of fluid path A, causing fluid to flow through a conduit 434 to the bi-directional hydraulic port 410. Similarly, the valve piston 404 comprises seals 424 and 426 that prevent fluid from flowing out of a conduit 430, which enables the fluid to flow through to the bi-directional port 410 in the operational position. Thus, when the valve piston 404 is in the operational position, hydraulic pressure may be applied to flowline D through the operational port 408 and the bidirectional port 410, locking the THRT 214 into the tubing hanger 216.

FIG. 4*b* shows the recovery valve 220 in a relief position, after kill pressure has been applied to the shear port 402. The application of kill pressure to the shear port 402 causes the shear ring 406 to shear, which releases the collar 407. The valve body includes a piston cavity 440 having a radially inwardly extending stop 442. The shear ring 406 is larger than the radially inwardly extending stop 442 and thus is prevented from moving into the piston cavity 440. This allows the valve piston 404 to move away from the shear port body 409 toward a relief port body 432 at a second end 401 of the recovery valve 220. The valve piston 404 sealingly engages the relief port body 432 in response to the kill pressure applied to the valve piston 404 through the shear port 402.

In the relief position, the valve piston 404 of the recovery valve 220 provides fluid communication between the bi-directional port 410 and a relief port 412 of the relief port body 432. In accordance with various embodiments, the fluid path B couples the bi-directional port 410 and the relief port 412, enabling hydraulic pressure to be released from flowline D. In some embodiments, the relief port 412 is fluidly coupled to the empty reservoir 302, which enables the release of pressure from flowline D through the bi-directional port 410 into the empty reservoir 302. As explained above, the valve piston 404 comprises seals 420 and 422; however, in the relief position, the seals 420 and 422 isolate a conduit 434, preventing fluid from flowing through conduit 434. Seals 422 and 424 prevent fluid from flowing outside of the fluid path B, which comprises the conduit 430 and a conduit 436 in the valve piston 404.

Referring back to FIG. 3, in the operational position, the recovery valve 220 enables pressure to be applied to flowline D by way of the operational port 408 and the bi-directional port 410. In other words, in the operational position, the operational port 408 and the bi-directional port 410 are fluidly coupled such that hydraulic pressure may be applied to flowline D through the recovery valve 220. In the relief position, the recovery valve 220 enables pressure to be released from flowline D into the reservoir 302 by way of the bi-directional port 410 and the relief port 412. In other words, in the relief position, the bi-directional port 410 and the relief port 412 are fluidly coupled such that hydraulic pressure may be released from flowline D into the reservoir 302.

In accordance with various embodiments, the recovery valve 220 enables the application of hydraulic pressure to flowline D (before kill pressure is applied to the shear port 402), which locks the THRT 214 into the tubing hanger 216. However, when kill pressure is applied to the shear port 402 after the activation of the shear ram 210, the valve piston 404 diverts fluid flow from flowline D to the empty reservoir 302, allowing the pressure from flowline D to be released and the THRT 214 to unlock from the tubing hanger 216. As explained above, flowline C is subjected to kill pressure as a result of its being sheared during the activation of the shear ram 210. The application of kill pressure both releases pressure from flowline D and applies pressure to flowline C, causing the THRT 214 to unlock from the tubing hanger 216 without the need to employ a hot stab type operation. This simplifies the later recovery of the THRT 214 and the lower body shear joint 212 from the subsea well using a shear joint recovery tool (not shown).

While specific embodiments have been shown and described, modifications can be made by one skilled in the art without departing from the spirit or teaching of this invention. The embodiments as described are exemplary only and are not limiting. Many variations and modifications are possible and are within the scope of the invention. For example, the recovery valve may enable hydraulic pressure to be applied and released from hydraulic lines that serve purposes other than to lock and unlock the THRT from the tubing hanger. Additionally, releasing pressure through the recovery valve in the relief position could be to any area of lower pressure than the pressure applied to the hydraulic line and does not necessarily have to be released into an empty reservoir. Accordingly, the scope of protection is not limited to the embodiments described, but is only limited by the claims that follow, the scope of which shall include all equivalents of the subject matter of the claims.

What is claimed is:

1. A tubing hanger landing system, comprising:

a tubing hanger running tool;

a locking flowline to lock the tubing hanger running tool into a tubing hanger; and a lower body shear joint comprising a recovery valve, the recovery valve comprising:

a valve body comprising a functional port, an operational port, a bi-directional port, and a relief port; and a valve piston positioned within the valve body and movable between an operational position and a relief position within the valve body;

wherein the functional port enables pressure to be communicated to the valve piston to move the valve piston from the operational position to the relief position; and wherein, in the relief position, the valve piston provides fluid communication through a relief flowpath between the bi-directional port and the relief port to release pressure from the locking flowline.

2. The tubing hanger landing system of claim 1, wherein, when the valve piston is in the operational position, the operational port is in fluid communication with the bi-directional port, and, when the valve piston is in the relief position, the bi-directional port is in fluid communication with the relief port.

3. The tubing hanger landing system of claim 1, wherein:

the valve body comprises an internal piston cavity, the piston cavity comprising a radially inwardly extending stop; and the valve piston is positioned in the valve body piston cavity and partially extending through the radially inwardly extending stop and movable relative to the radially inwardly extending stop, the valve piston comprising a radially extending collar.

4. The tubing hanger landing system of claim 1, wherein:

the functional port comprises a shear port;

a shear ring is attached to the valve piston to prevent the valve piston from moving from the operational position to the relief position; and the shear ring is shearable from the valve piston when subjected to a pressure of through the shear port that exceeds a shear force of the shear ring, thereby allowing the valve piston to be movable to the relief position.

5. The tubing hanger landing system of claim 1, wherein, when the valve piston is in the operational position, the operational port and the bi-directional port are capable of having pressure applied therethrough, thereby causing the tubing hanger running tool to lock into the tubing hanger.

6. The tubing hanger landing system of claim 1, wherein, when the valve piston is in the relief position, the bi-directional port is capable of having pressure released therefrom into an area having a lower pressure coupled to the relief port.

7. The tubing hanger landing system of claim 6, wherein the area having a lower pressure is a reservoir.

8. The tubing hanger landing system of claim 6, wherein releasing the pressure from the bi-directional port enables the tubing hanger running tool to unlock from the tubing hanger.

9. The tubing hanger landing system of claim 1, further comprising an unlocking flowline to unlock the tubing hanger running tool from the tubing hanger; wherein activation of a shear ram cuts the unlocking flowline and exposes the unlocking flowline and the functional port to kill fluid pressure, the kill fluid pressure causing the tubing hanger running tool to unlock from the tubing hanger when the relief valve is in the relief position.

10. A recovery valve, comprising:

a valve body comprising a functional port, an operational port, a bi-directional port, and a relief port; and a valve piston positioned within the valve body and movable between an operational position and a relief position within the valve body such that, in the operational position, the operational port is in fluid communication with the bi-directional port, and, in the relief position, the bi-directional port is in fluid communication with the relief port, wherein the functional port enables pressure to be communicated to the valve piston to move the valve piston from the operational position to the relief position.

11. The recovery valve of claim 10, wherein:

the valve body comprises an internal piston cavity, the piston cavity comprising a radially inwardly extending stop; and the valve piston is positioned in the valve body piston cavity and partially extending through the radially inwardly extending stop and movable relative to the radially inwardly extending stop, the valve piston comprising a radially extending collar.

12. The recovery valve of claim 10, wherein:

the functional port comprises a shear port;

a shear ring is attached to the valve piston to prevent the valve piston from moving from the operational position to the relief position; and the shear ring is shearable from the valve piston when subjected to a pressure through the shear port that exceeds a shear force of the shear ring, thereby allowing the valve piston to be movable to the relief position.

13. A method of recovering a tubing hanger running tool (THRT) from a subsea assembly of a subsea well, comprising:

lowering the THRT attached to a lower end of a drill pipe into the subsea assembly;

locking the THRT to a tubing hanger within the subsea assembly;

shearing the drill pipe with a shear ram; and injecting kill fluid having a pressure into an annulus between the shear ram and the tubing hanger to unlock the THRT from the tubing hanger.

14. The method of claim 13, wherein locking the THRT to the tubing hanger comprises applying pressure to a locking flowline of the THRT through a recovery valve comprising a valve piston in an operational position within the recovery valve.

15. The method of claim 14, further comprising:

applying the kill fluid pressure to a port of the recovery valve that fluidly couples the exterior of the recovery valve to the valve piston;

wherein, in the first position, the valve piston is coupled to the port by a shear ring having a shear pressure less than the kill pressure; and wherein applying the kill fluid pressure to the valve piston by way of the port causes the shear ring to shear and the valve piston to be in the relief position.

16. The method of claim 14, wherein locking the THRT into the tubing hanger further comprises applying pressure to an operational port of the recovery valve, wherein the valve piston provides fluid communication between the operational port and a bi-directional port of the recovery valve in the operational position.

17. The method of claim 14, wherein unlocking the THRT from the tubing hanger comprises releasing the pressure applied to the THRT to lock the THRT into the tubing hanger into an area having a lower pressure than the hydraulic pressure applied when the valve piston is in a relief position, and wherein the kill fluid pressure causes the valve piston to be in the relief position.

18. The method of claim 17, wherein the valve piston provides fluid communication between the bi-directional port and a relief port of the recovery valve in the relief position.

19. The method of claim 13, wherein unlocking the THRT from the tubing hanger is caused by exposing an unlocking flowline sheared by the shear ram to the kill fluid pressure.

20. The method of claim 13, further comprising recovering the THRT.

* * * * *